United States Patent [19]

Darling

[11] 3,971,232

[45] July 27, 1976

[54] ROTARY KNITTING MACHINE

[76] Inventor: Phillip H. Darling, c/o Bentley Labs., Inc., 17502 Armstrong, Irvine, Calif. 92705

[22] Filed: Aug. 27, 1973

[21] Appl. No.: 392,069

Related U.S. Application Data

[63] Continuation-in-part of Ser. No. 273,819, July 21, 1972, abandoned.

[52] U.S. Cl. ..... 66/1 R; 112/181; 112/201; 112/228

[51] Int. Cl.[2] ..... D04B 23/04; D05B 57/04; D05B 57/30

[58] Field of Search ..... 112/156, 181, 198, 199, 112/201, 221, 228; 66/1 R

[56] References Cited

UNITED STATES PATENTS

| | | | |
|---|---|---|---|
| 393,766 | 12/1888 | Kohler et al. | 112/201 |
| 859,423 | 7/1907 | Ammerman | 112/201 |

FOREIGN PATENTS OR APPLICATIONS

| | | | |
|---|---|---|---|
| 41,076 | 4/1886 | Germany | 66/1 R |
| 81,588 | 6/1894 | Germany | 66/1 R |
| 26,211 | 3/1907 | Sweden | 112/201 |

*Primary Examiner*—Werner H. Schroeder

[57] ABSTRACT

A knitting machine capable of forming filaments of yarn, thread, and the like into a loop-in-loop arrangement includes a plurality of rotary needles which are axially spaced for rotation about a common axis and have at least two circumferentially spaced hook portions. As a needle is rotated, a hook captures a segment of filament being fed to the vicinity of the needle and pulls it into a loop. Upon further rotation, the circumferentially adjacent hook captures another segment of filament and pulls it into a loop through the previously formed loop which is still carried by the needle. As the needle continues to rotate, the first formed loop is cast off the needle by slipping out of the hook in which it is captured and this hook captures another segment of filament to start another cycle. The needles are rotated by an external drive means which either engages the needle periphery outside the loop catching and forming area or electrically couples the needles so they are rotated about their own central axis without an encumbering mechanical axis.

11 Claims, 25 Drawing Figures

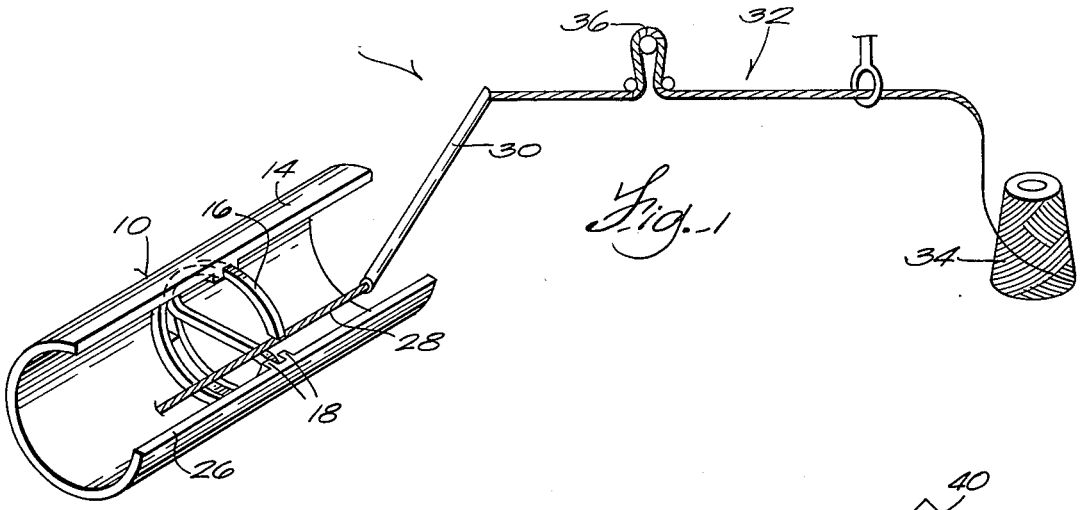
Fig. 1
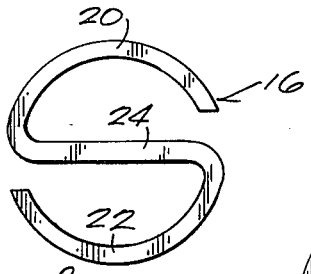
Fig. 2
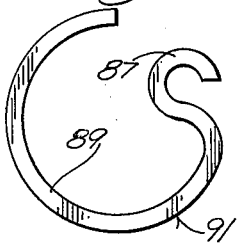
Fig. 11
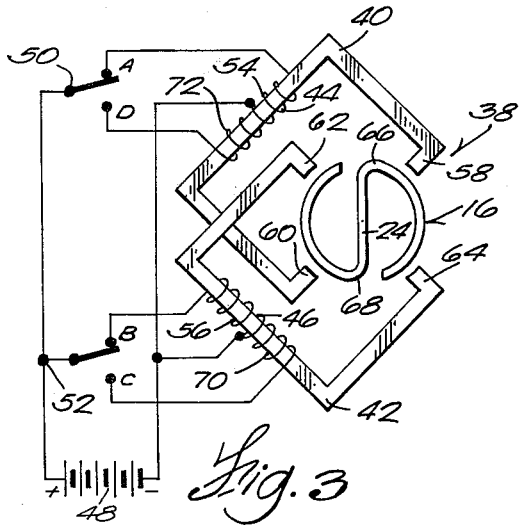
Fig. 3
Fig. 4
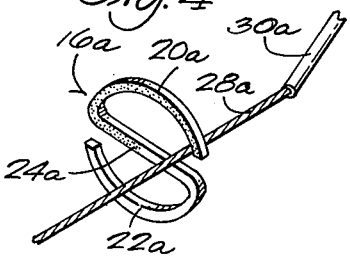
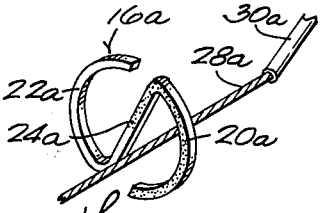
Fig. 5
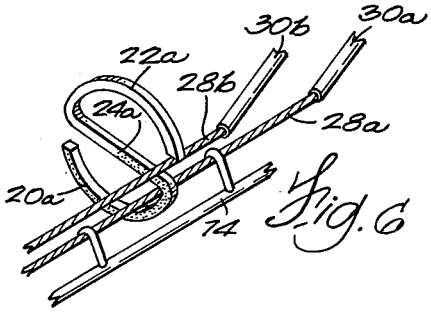
Fig. 6
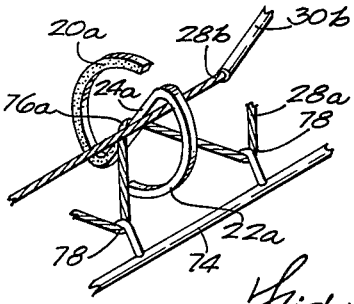
Fig. 7
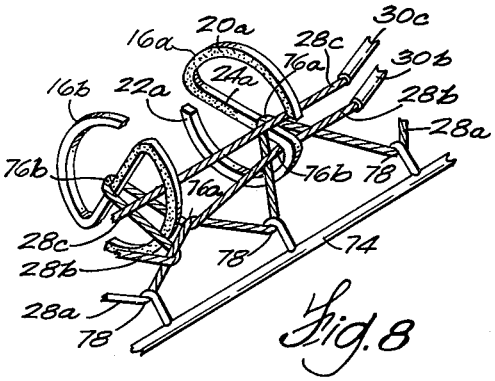
Fig. 8

ROTARY KNITTING MACHINE

CROSS-REFERENCE TO RELATED APPLICATIONS

This application is a continuation-in-part of application Ser. No. 273,819, filed July 21, 1972, now abandoned.

BACKGROUND OF THE INVENTION

Conventional knitting machines generally employ either a plurality of spring beard or latch needles carried in a cylinder. In either case the needles are reciprocated in a manner so that the beard or latch is sequentially opened and closed so the hook of the needle may grasp a segment of thread or yarn being laid under the hook of the needle at the proper point in its cycle, and pull it into a loop, pull the new loop through a previously formed loop, and cast off a previously formed loop. The rate of this reciprocative movement of the needles, which must be coordinated with a mechanism feeding thread to the needles, is the primary limiting factor on the production rate of the knitting machines. Also, this reciprocative movement induces vibrations which must be designed for. In addition, the lateral distance between the thread feeding points on a reciprocating machine must be large enough to accommodate the lateral axial traversing of the needles in the ramped raceways required to produce the reciprocating needle movement.

As a means for eliminating some of these problems, German patent 1,809,347, issued Dec. 23, 1970, proposes providing rotary needles which include at least two hooked gripping elements and which are supported between and are rotated by three triangularly disposed drive shafts drivingly engaging the periphery of the needles. Such a three point drive and suspension system becomes unstable when the open portion of a hook section passes under one of the supporting drive shafts, i.e. the needle is radially displaced so that the line between the other two supporting shafts does not pass through the center of rotation resulting in an eccentric rotation of the needles. Also, the needles can only be rotated in one direction and at a common speed, thereby limiting the type of knitted fabric and/or patterns capable of being produced.

SUMMARY OF THE INVENTION

A principal object of this invention is to provide a knitting machine which is capable of forming filaments into a loop-in-loop arrangement without a reciprocative movement.

Another principal object of this invention is to provide a knitting machine including rotary needles and drive means therefor which is arranged to provide stable operation of the needles.

A further principal object of this invention is to provide such a knitting machine wherein the rotary needles and drive means therefor are arranged to provide the capability of rotating adjacent needles at different speeds and/or in opposite directions.

A still further object of this invention is to provide such a knitting machine wherein the rotary needles are arranged to sequentially produce loops of different sizes.

Other objects, aspects and advantages of this invention will become apparent upon reviewing the following detailed description, the drawings, and the appended claims.

According to this invention, filaments of thread, yarn, wire or the like are formed into a loop-in-loop arrangement with a rotary needle having at least two circumferentially spaced, loop forming means which are capable of capturing and holding a segment of filament as the needle is rotated. The needle is rotated by an external means which either engages the needle periphery outside the loop catching and forming area or electrically couples the needle so it is rotated about its own lateral central axis without an encumbering central mechanical axis. If desired, segments of more than one filament can be fed into one loop forming means before the needle is rotated so that all of such segments are pulled into one loop. Secondary filaments can be inserted into the needles, in addition to the basic fabric generating filament, for patterning purposes.

The loop forming means preferably comprise two or more hook portions which are similarly oriented with respect to the direction of needle rotation. The hook portions sequentially capture segments of filament and pull them into loops as the needle is rotated. The rotary needle can also be used in conjunction with a reciprocating sewing machine to produce bobbin-less chain stitching. Also, the needles can be rotated at different relative speeds so that more than one filament is fed into a single hook section of some of the needles before a loop is pulled. Further, a loop can be prevented from being cast off and then recaptured by the same hook, along with a new thread, and pulled through a second cycle.

In accordance with one embodiment of this invention, a five-point mechanical drive system is provided for driving the rotary needles including five equally, circumferentially spaced drive rods between which the needles are supported and which drivingly engage the periphery of the needles to rotate the needles about a common axis.

In accordance with another embodiment of this invention, a plurality of rotary needles are carried in a raceway in axially spaced relationship for rotation about a common axis and a plurality of circumferentially spaced teeth are provided on the periphery of each needle. The needles are rotated in the raceway by an axially movable rack-like mechanism including a plurality of teeth which are angularly arranged with respect to the rotational axis of the needles and which engage the needle teeth and cause the needles to rotate as the mechanism is moved along their axis of rotation. The raceway can be arranged to carry two separate groups of needles having different rotational axes but disposed so that the hook portions of the needles from both groups overlap during rotation. With this arrangement, one group of needles can be rotated in one direction with the other group being rotated in the same or opposite direction so that a single filament can be captured and formed into loops by both groups to form a jersey fabric and a ribbed fabric, respectively.

In accordance with another embodiment of this invention, a plurality of rotary needles are carried in axially spaced relationship for rotation about a common axis within a generally tubular raceway which has an elongated opening for receiving filaments to be inserted into the needle hook sections and the needles are driven by an electromagnetic system. At least two electromagnets are disposed adjacent the outher periphery of the raceway and each needle includes permanent magnets to act as a rotor of a multi-phase motor.

BRIEF DESCRIPTION OF THE DRAWINGS

FIG. 1 is a perspective view of a rotary needle assembly of this invention, partially broken away, shown embodied in a knitting machine which is illustrated in partial diagrammatic form.

FIG. 2 is a side elevational view of a rotary needle arranged according to one embodiment of this invention.

FIG. 3 is a diagrammatic representative of an electromagnetic system for driving a rotary needle in accordance with one embodiment of the invention.

FIGS. 4–8 are perspective views of the rotary needle of FIG. 2 illustrating the various steps of the loop generation provided thereby.

FIGS. 9–12 are side elevational views of alternate arrangements for the rotary needles.

DESCRIPTION OF THE PREFERRED EMBODIMENTS

Figure 9:
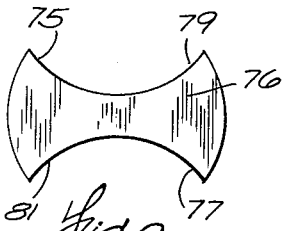

Before explaining the invention in detail, it is to be understood that the invention is not limited in its application to the details of construction and arrangement of components set forth in the following description and illustrated in the drawing. The invention is capable of other embodiments and of being practiced and carried out in various ways. For instance, the knitting machine provided by the invention is particularly adaptable for knitting yarn into fabrics and will be described for this use. However, it can be readily adapted for use in knitting wire and other filaments into a meshed product.

In FIG. 1, a rotary needle assembly 10 arranged in accordance with this invention is shown embodied in a diagrammatically illustrated fabric knitting machine 12. The knitting machine 12 generally can be of conventional design with the exception of the rotary needle assembly, auxiliary equipment necessary to power the rotary needles, and whatever suitable adaptations are required to supply filaments of yarn to the rotating needles for the knitting operation as explained below.

In the embodiment illustrated in FIG. 1, rotary needle assembly 10 includes a generally tubular raceway 14 carrying a plurality of axially spaced rotary needles 16 (one shown) for rotation about a common axis 17. Each needle 16 is rotatably disposed in a race 18. As shown in FIG. 2, each rotary needle can be generally S-shaped and have oppositely directed hook portions 20 and 22 which extend from the opposite ends of a cross member 24. The raceway 14 has an elongated slot 26 into which a filament 28 is introduced so that the hook portions can capture a segment of the filament as the needles are rotated. The width of slot 26 can vary over a reasonably broad range. It must be wide enough to permit filaments of the material being knitted to be guided under the tips of the hook portions of the rotary needles, with the maximum width being that at which sufficient race bearing surface exists to retain the needles in their rotary path.

A filament 28 of yarm is fed through a yarn guide or leader 30 in a suitable manner from a yarn supply system 32, including a yarn supply spool 34 and a suitable variable tensioning device 36. A plurality of yarn leaders and yarn supply systems can be provided in the usual manner so that separate yarn filaments are fed into the hooks of each needle at the proper point of its rotational cycle. When a needle has rotated to the yarn capturing position shown in FIG. 1, the yarn, guided into opening under the tip of the exposed hook portion of a needle by a yarn leader, is captured by the needle.

To produce a warp knitted fabric, rotation of the needles is phased so that hook portions simultaneously arrive at the yarn capturing position. Separate yarn leaders can be provided for each needle in the usual manner. If desired, a single filament of yarn can be laid across all the needles by a yarn leader before the needles are rotated past the yarn capturing position, in which case rotation of the needles can be interrupted while the yarn is being laid in.

To produce a weft knitted fabric, rotation of the needles is phased so that the hook portions of adjacent needles sequentially arrive at the yarn capturing position. Either yarn leader 30 is swept past the needles in a direction parallel to rotational axis of the needles (from left to right as viewed in FIG. 1) in phase with the rotation of the needles or raceway 14 is swept past a stationary yarn leader (from right to left as viewed in FIG. 1) so that the yarn is guided under each of the needles as they reach the yarn capturing position.

In accordance with the invention, means are provided for rotating each rotary needle 16 about its own central lateral axis without encumbering the central portion of the needle so that hook portions 20, 22 capture a segment of filament being guided into the raceway slot and draw it into a loop as described below.

FIG. 4–8 illustrate the knitting action provided by the rotary needles. A weft knitting process will be described with the raceway carring the needles being stationary and the yarn leaders being moved laterally (to the right as viewed in FIGS. 4–8) past the needles in a direction parallel to their rotational axis to thereby guide the yarn beneath the needle hook portions as they reach the yarn capturing position. Hook portion **20*a* of the needle 16*a* has been darkened to facilitate following the steps during the loop generating process. For purposes of clarity, rotary needle 16*a* is shown removed from raceway 14.**

Referring to FIG. 4, a filament 28*a* of yarn, the left end of which (as viewed in FIG. 4) is initially restrained to provide the necessary tension for loop generation, is guided into the raceway slot by a first leader 30*a* which is moved laterally to the right in phase with the rotating needles as described above. As needle 16*a* rotates clockwise 90° from its starting position, the tip of hook portion 20*a* captures a segment of filament 28*a* (FIG. 5). While needle 16*a* is rotating clockwise an additional 90° from its starting position, a second filament 28*b* of yarn is guided into the raceway slot by a second leader 30*b* which follows first leader 30*a* by a proper distance and at a proper lateral speed relative to the needles to lay the yarn under the tip of hook portion 22*a* as it arrives at the hook capturing position (FIG. 6). In the position shown in FIG. 6, hook portion 20*a* is beginning to pull filament 28*a* into a loop and hook portion 22*a* is ready to capture a segment of filament 28*b*. As shown in FIG. 6, a starting puller 74 or similar means can be hooked over filament 28*a* at locations intermediate the needles to restrain the filament in a manner so that initial loops can be formed therein. Upon further clockwise rotation of needle 16*a*, hook portion 20*a* pulls filament 28*a* into a loop and hook portion 22*a* captures a segment of filament 28*b*.

As shown in FIG. 7, needle 16*a* has been rotated slightly past 270° from its starting position. In this position, hook portion 20*a* has pulled a loop 76*a* into filament 28*a*, loop 76*a* is beginning to slip off the top of the needle cross member 24*a*, and hook portion 22*a* has captured a segment of filament 28*b*. Tension is applied to puller 74 to assist in the generation of the initial loops in filament 28*a*. Once the knitting operation is started, the loops 78 formed by puller 74 can be mounted on a take-up or the like in a suitable manner so that the knitted fabric is pulled from the needles and is maintained under a suitable tension required for continued loop generation.

As shown in FIG. 8, needle 16*a* has been rotated clockwise 360° from its starting position, loop 76*a* is slipping alipping off the needle cross member 24*a* and hook portion 22*a* is pulling filament 28*b* into loop 76*b* through loop 76*a*. Simultanteously, hook portion 20*a* is beginning to capture a segment of filament 28*c*, which has been guided into the raceway slot by a third leader 30*c* which follows second leader 30*b*.

A second needle 16*b* is shown in FIG. 8 to illustrate the different phase relationship between adjacent needles. For purposes of illustration needle 16*b* is shown rotated 90° further than needle 16*a*. In actual practice, the relative phasing between adjacent needles can be more or less than 90° and constant or variable depending on the fabric arrangement desired. This decoupling of the rotation of adjacent needles is possible when each needle is separately driven, e.g., by an electromagnetic system as described below.

The rotary needle can have a wide variety of geometric configurations so long as it is arranged to be capable of capturing one filament segment and pulling it into a loop, capturing and pulling another filament segment into a loop through the previously formed loop and then allowing the loops to slip off as it is rotated. The size of the loop formed can be varied by the shape and depth of the internal portion of the hook portions. If the hook portions are arranged so that the filament is led directly to the center of rotation, small loops are drawn. On the other hand, if the hook portion is arranged so that the loop remains captured during a large portion of the rotation, longer loops are drawn. Generally, the limits of the geometric configuration of the needle can be defined in terms of the loop length. If the hook portions are symmetrically arranged, the smallest loop which can be drawn generally is one half of the effective diameter of the rotary needle plus the width of the cross member. The longest loop which can be drawn is the full effective diameter of the needle plus the length of the hook portion necessary to capture a segment of a filament being knitted and hold it during the loop formation portion of rotation.

Figure 10:
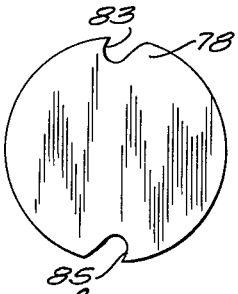

FIGS. 9 and 10 illustrate exemplary configurations of rotary needles 76 and 78 which are capable of providing small and long loops, respectively. Needle 76 shown in FIG. 9 is also capable of being rotated either clockwise or counterclockwise to form the loops, which may be advantageous for some fabric arrangements. As viewed in FIG. 9, hook portions 75 and 77 sequentially capture the yarn and pull it into loops when the needle is rotated clockwise and hook portions 79 and 81 sequentially capture the yarn and pull it into loops when the needle is rotated counterclockwise. Hook portions 83 and 85 of needle 78 shown in FIG. 10 sequentially capture the yarn and pull it into loops as the needle is rotated clockwise.

Hoop portions 87 and 89 of needle 91 shown in FIG. 11 are asymmetrically arranged. When needle 91 is rotated clockwise, hook portion 87 pulls a long loop and hook portion 89 pulls a small loop with the combined length of the loops being substantially the total effective diameter of needle 91.

Figure 12:
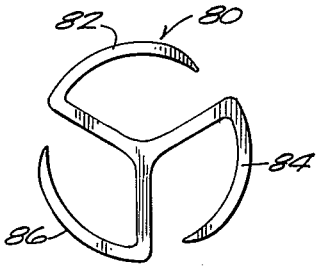

If desired, the rotary needle can be arranged with several hook portions. For example, a rotary needle 80 having three hook portions 82, 84 and 86 is illustrated in FIG. 12. The loop generation is provided by rotary needle 80 is basically the same as that provided by a rotary needle having two hook portions, as described above, except the resultant fabric produced thereby has two loops in each loop, i.e. during each cycle hook portions 84 and 86 both pull loops through a loop pulled a hook portion 82. It will be readily apparent that a rotary needle can be provided with many more hook portions, with the upper limit being dictated primarily by the size of the filament being knitted and the diameter of the needle being used.

The needles are driven by an external means which rotates each needle 16 about its own central axis without mechanically encumbering the loop forming areas and yet providing stable needle operation.

An electromagnetic system 38 suitable for this purpose is diagrammatically illustrated in FIG. 3. Each of the rotary needles can be driven by a separate electromagnetic system. Electromagnetic system 38 includes two electromagnets 40 and 42 having center tap windings 44 and 46, respectively. Windings 44, 46 are connected to a suitable power source 48 through stepping switches 50 and 52. The windings are interconnected in conventionally arranged electrical circuitry to the power source, to the stepping switches, and to each other so that the plarity of the electromagnets is reversed by changing the position of the stepping switches. Cross member 24 of rotary needle 16 is permanently magnetized and the poles of the electromagnets 40 and 42 are located adjacent the periphery of the needle so that the needle, in cooperation with the electromagnets, acts as an armature of a 4-phase, 2-pole electric motor. The needles can be magnetized in any other suitable manner which provides the necessary polarity for them to be rotated by electromagnets.

For example, when the switches 50 and 52 are in positions A and B, respectively (as shown in FIG. 3), phase 54 of winding 44 is energized and phase 56 of winding 46 is energized. Poles 58 and 60 of electromagnet 40 are north and south, respectively, and poles 62 and 64 of electromagnet 42 are north and south, respectively. The south pole 66 of cross member 24 is disposed between poles 58 and 62 and the north pole 68 of cross member 24 is disposed between poles 60 and 64. When switch 52 is changed to position C (with switch 50 remaining in position A), phase 70 of winding 46 is energized, reversing the polarity of electromagnet 42 (i.e. pole 62 becomes south and pole 64 becomes north), and phase 54 of winding 44 remains energized. The resultant polarity of electromagnets 40 and 42 with respect to cross member 24 causes the needle to be rotated clockwise 90° from its starting position with south pole 66 of cross member 24 disposed between poles 58 and 64 and the north pole 68 of cross member 24 disposed between poles 60 and 62. When switch 50 is changed to position D (with switch 52 remaining in position C), phase 72 of winding 44 is energized, reversing the polarity of electromagnet 40 (i.e. pole 58 becomes south and pole 60 becomes north). and phase 70 of winding 46 remains energized. The resultant polarity of the electromagnets with respect to needle cross member causes needle 16 to be rotated clockwise an additional 90° from its starting position, with the south pole 66 of cross member 24 being disposed between poles 60 and 64 and the north pole 68 of cross member 24 disposed between poles 62 and 58. In a like manner, the needle is rotated further to complete a full cycle by sequentially returning switches 52 and 50 to positions B and A, respectively.

In this embodiment, one or more of the rotary needles can be rotated in reverse at any time during the cycle by appropriate positioning of the stepping switches of the corresponding electromagnetic system. This feature can be used to capture a segment of filament and then cast it off without pulling a loop which may be advantageous for some types of fabric arrangements.

In FIG. 3, the electromagnetic system 38 is shown in diagrammatical form to facilitate the describing the operation. In actual practice, raceway 14 can be made from a non-magnetic material with the poles of the electromagnets positioned against the outer surface of or imbedded in the raceway. If desired, additional electromagnetic magnets can be used, e.g., four electromagnets arranged to form an 8-phase system. The strength of the fields of the electromagnets is adjusted with respect to the tension applied on the filament by variable tension device 36 so that loops of desired tautness are pulled by the rotary needles.

Figure 13:
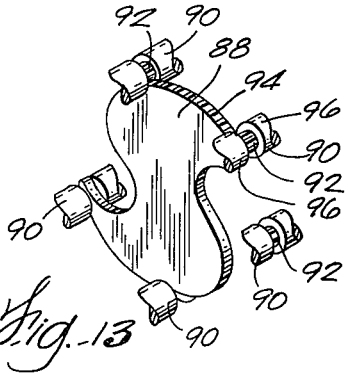
FIG. 13 is a perspective view, partially broken away, illustrating a five-point suspension system for driving the rotary needles in accordance with another embodiment of this invention.

FIG. 13 illustrates an alternate embodiment whereby the rotary needles are rotated by a mechanical means. In this embodiment, the rotary needles 88 (one shown) are supported between and are rotated by five drive rods 90, which drivingly engage the periphery of the needles and rotate them about their own axis. Drive rods 90 are rotated about their own axes by a suitable drive means (not shown), such as transfer gears meshing with a common drive gear located at one end of the needle assembly. Drive rods 90 are rotationally synchronized and circumferentially spaced (and preferably at equal intervals) with respect to the needles so that at least three are engaged with the periphery and drive the needle at all times during rotation. Thus, at least a three point (axis) suspension is provided for the needles to thereby insure stable operation of the needles, i.e., the needles continue to rotate about their own axis through the entire cycle irrespective of the relative locations of the hook portions and the drive rods.

Drive rods 90 preferably include a geared driving surface 92 which meshes with teeth 94 provided on the periphery of needle 88. The teeth of driving surface 92 and teeth 94 on the needle are arranged so that adjacent needles can be set with a precise relative rotational phasing required to cooperate with the yarn being fed to the needles. The portions 96 of the drive rod between adjacent needles can be arranged with an enlarged diameter so as to act as lateral retainers for the needles.

Figure 19:
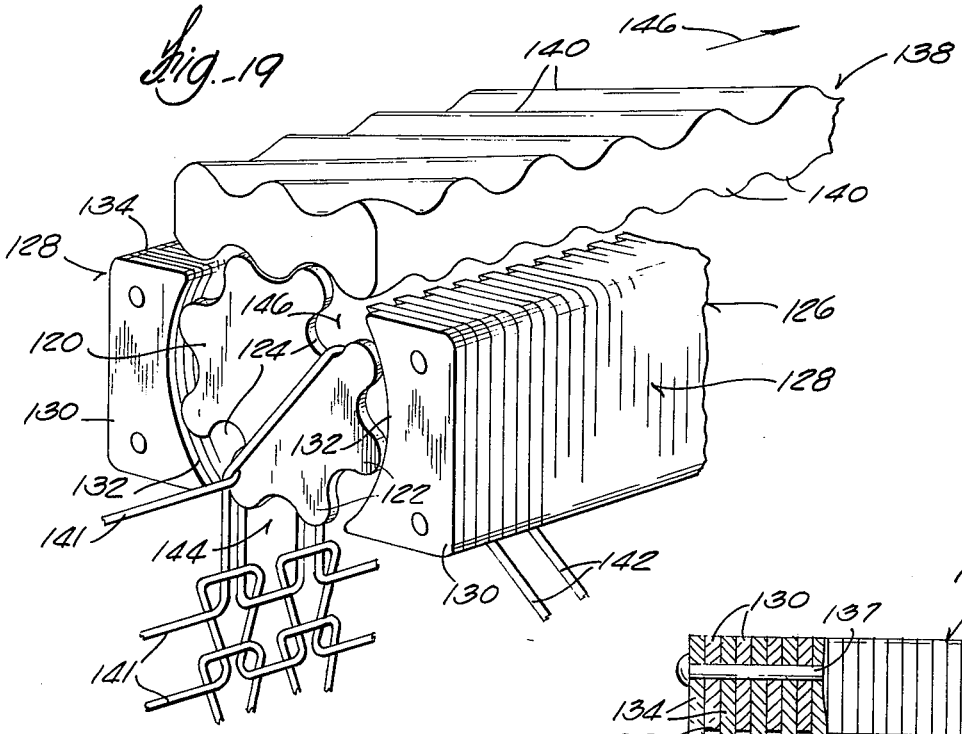
FIG. 19 is a perspective view of an alternate mechanical system for driving the rotary needles.
Figure 20:
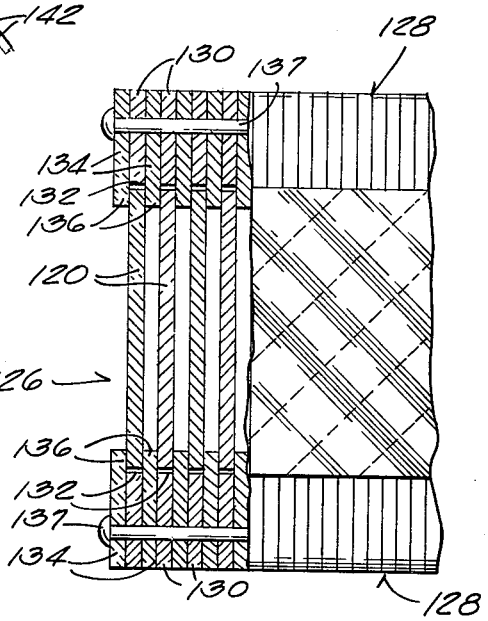
FIG. 20 is a fragmentary, top plan view, partially broken away, of the mechanical system shown in FIG. 19.

FIGS. 19 and 20 illustrate an alternate embodiment for a mechanical drive means. In this embodiment, the rotary needles 120 are each generally in the form of a flat, circular disc having a plurality of gear teeth 122 which are equally spaced around the outer circumference thereof. Provided in the vicinity of at least two of gear teeth 122 (and diammetrically opposed when only two are provided) are hook portions 124 fr capturing a strand of yarn.

A plurality of rotary needles 120 (one shown) are mounted in axially spaced relationship within a raceway 126 for rotation about a common axis 127, i.e., the central axis of the needles. Raceway 126 includes a pair of spaced sections 128 which are identically arranged and include a plurality of race segments 130 having an arcuate inner surface 132. When raceway sections 128 are assembled and disposed in the opposed, spaced relationship shown, corresponding race segment surfaces 132 of the two raceway sections 128 cooperate to define diammetrically opposed arcs having a radius slightly larger, but closely approximating, that of the outermost radius of rotary needles 120. Located on the opposite sides of each race segment 130 are spacer elements 134 which provide the axial spacing between adjacent rotary needles 120 and include an inner edge portion 136 extending radially inwardly from race segment surface 132 to laterally retain rotary needles 120.

Race segments 130 and spacer elements 134 of each raceway section 128 are held together in side-by-side relationship by a suitable fastening means, such as bolts 137. Raceway sections 128 are suitably supported on a support structure (not show) is spaced relationship so that rotary needles are rotatably captured between the surfaces 132 of diammetrically opposed race segments 130. In FIG. 19, the spacer element on the outer end of each raceway section 128 has been removed to facilitate illustration of locating the rotary needle.

Rotary needle 120 are rotated by an axially movable rack-like drive member 138 including grooves or ridges 140 on the bottom surface thereof for slidably engaging rotary needle teeth 122. Ridges 140 on drive member 138 are angularly arranged with respect to the rotational axis of rotary needles so that axial movement of drive member 138 relative to the needles, with ridges 140 in driving engagement with rotary needle teeth, will cause rotary needles 120 to be rotated. Thus, ridges 140 and needle teeth 122 cooperate in a manner so that linear motion of drive member 138 is translated into rotational motion of rotary needles 120, i.e., rotary needles 120 act somewhat like pinion gears.

Yarn 141 is guided by yarn leaders 142 into hook portions 124 of rotary needles 120 when the hook portions are located in a yarn capturing position within the bottom gap 144 between raceway sections 128. Upon rotation by drive member 138, rotary needles form the yarn into loops in the manner described above. For example, in the specific arrangement illustrated, axial movement of drive member 138 in the direction of arrow 146 will cause rotary needles 120 to be rotated clockwise. When four of ridges 140 on drive member 138 have moved past a rotary needle 120 having eight teeth 122, the needle will rotate 180°. Since a new strand of yarn 141 must be laid into needle hook portion 124 after each 180° rotation, yarn leaders 142 can be axially spaced relative to rotary needles 120, as close together as the axial center-to-center distance across five ridges 140 of drive member 138 when the ridges are spaced continuously along the surface of the drive member as shown.

Figure 21:
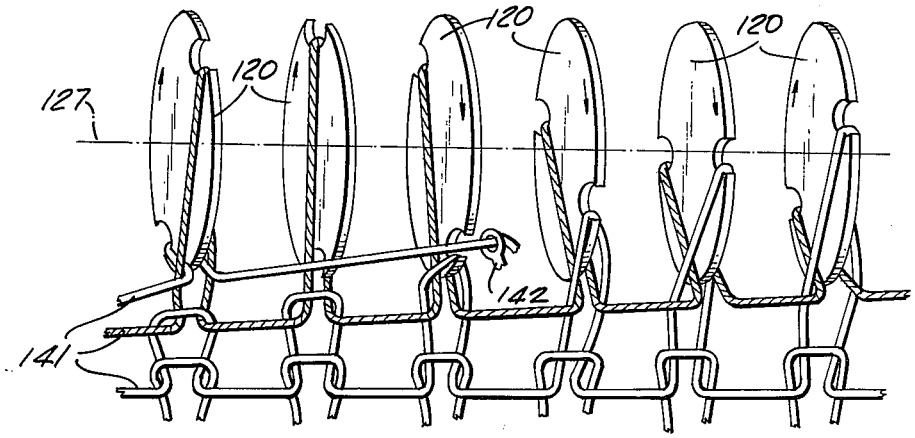
FIG. 21 is a perspective view illustrating weft knitting by the system of FIG. 19.

FIG. 21 illustrates the fabric produced by the assembly shown in FIGS. 19 and 20 when the yarn 141 is laid into the needle hook portions 124 by yarn leaders 142 is the usual manner for weft knitting. The rotary needles are shown in their relative rotational positions as drive member 138 is moved from left to right.

Figure 22:
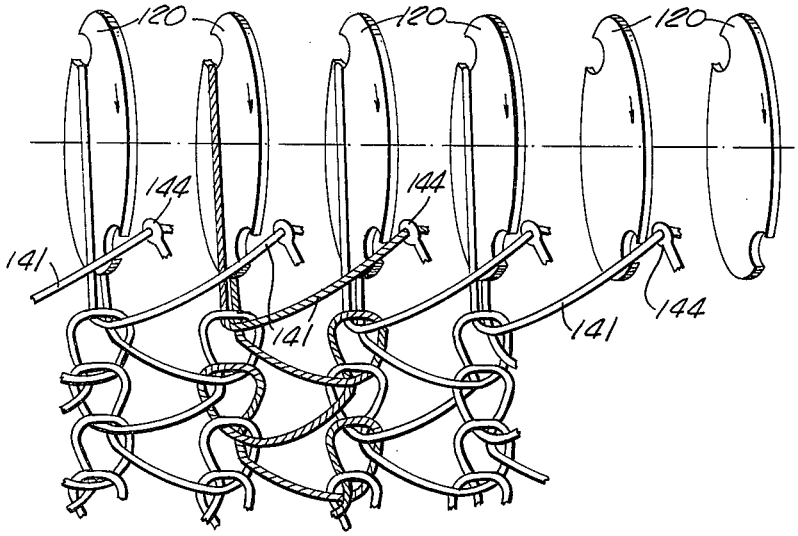
FIG. 22 is a perspective view illustrating warp knitting by the system of FIG. 19.

FIG. 22 illustrates the fabric produced by the assembly shown in FIGS. 19 and 20 when the yarn 141 is laid into the needle hook portion 124 by a plurality of yarn leaders 144 in the usual manner for warp knitting. In FIGS. 21 and 22, the needle teeth have been omitted for the purpose of clarity.

The fabric generation shown in FIGS. 21 and 22 can be augmented by laying in secondary yarns into needle hook portions 124 when they are in the position designated as 146 in FIG. 19. In this case, the width of drive member 138 is dimensioned so there is sufficient clearance between drive member edge 148 and the right hand raceway section 128 for one or more yarn leaders (not shown) to guide the secondary yarns into the needle hook portions. The yarn leaders can be arranged in the usual manner so that the secondary yarns are guided in and out of the knitting operation to provide patterning.

As illustrated in FIGS. 21 and 22, rotary needles 120 always rotate in the same direction. Thus, if drive member 138 is reciprocated back and forth across the needles, the ridges 140 must be reoriented 180° for each stroke. This can be accomplished by providing means (not shown) which at the end of each stroke disengages drive member 138 from the needles, rotates the arm member 180°, and then re-engages the drive member with the needles. Alternatively, as shown in FIG. 19, drive member 138 can be provided with ridges 140 on both sides with the ridges on one side being arranged at 90° relative to those on the other side. In this case, drive member 138 need only be turned over at the end of each stroke. Although less desirable because of the added complexity, the motive means for drive member 138 can be arranged so that the drive member drivingly engages the rotary needles in only one direction of reciprocating axial travel. Raceway 128 may also be arranged in a circle so drive member 138 can continuously drive without reversing its direction.

Figure 23:
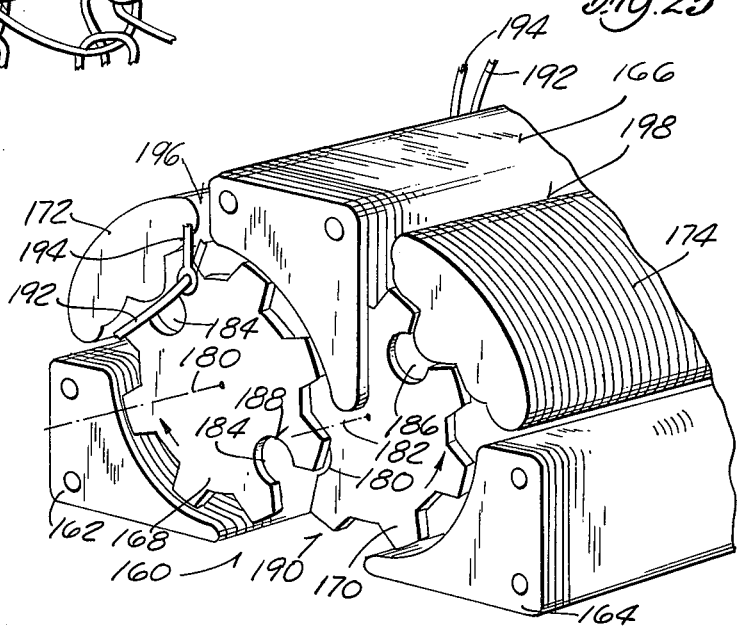
FIG. 23 is a perspective view illustrating an alternate arrangement for the mechanical drive system shown in FIG. 19.
Figure 24:
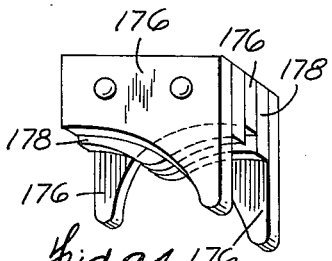
FIG. 24 is a fragmentary view of one of the raceway sections of the system shown in FIG. 23.

FIGS. 23 and 24 illustrate an alternate embodiment employing the same type of mechanical drive system as that shown in FIGS. 19 and 20, but is arranged so that either a ribbed fabric or a plain jersey fabric can be produced. In this embodiment, the raceway 160 includes three raceway sections 162, 164 and 166, separate banks of rotary needles 168 (one shown) and 170 (one shown) are provided, and rotary needles 168 and 170 are rotated by separate drive members 172 and 174, respectively. Raceway sections 162 and 164, drive members 172 and 174, and rotary needles 168 and 170 are constructed in the same general manner as corresponding components in FIGS. 19 and 20. Raceway section 166 (FIG. 24) is arranged so that race segments 176 and spacer elements 178 thereof cooperate with raceway sections 162 and 164 to respectively capture a plurality of rotary needles 168 and 170 in overlapping relationship for rotation about parallel axes 180 and 182, respectively.

In the specific construction illustrated, raceway sections 162, 164 and 166 are arranged so that individual rotary needles 168 and 170 are alternately disposed. However, it should be understood that the raceway sections can be arranged so that groups of adjacent rotary needles 168 can be alternated with groups of adjacent rotary needles 170. In either case, rotary needles 168 and 170 are disposed so that the respective hook portions 184 and 186 thereof coincide at point 188 within the gap 190 between raceway sections 162 and 164 so that the same strand of yarn can be captured by both rotary needles 168 and 170 and pulled into loops thereby.

The yarns 192 are guided by axially movable yarn leaders 194 into hook portions 184 of rotary needles 168 when the hook portions 184 are exposed in the gap 196 between drive member 172 and raceway section 166. If desired, in order to provide patterning, secondary yarns can be similarly guided into the hook portions 186 of rotary needles 170 when the hook portions 186 are exposed in the gap 198 between raceway section 166 and drive member 174. The ridges (not shown) of drive members 172 and 174 are arranged so that rotary needles 168 and 170 rotate in the same or opposite directions. When the rotary needles are rotated in opposite directions. a ribbed fabric is produced and, when rotated in the same direction, a plain jersey fabric is produced.

Figure 25:
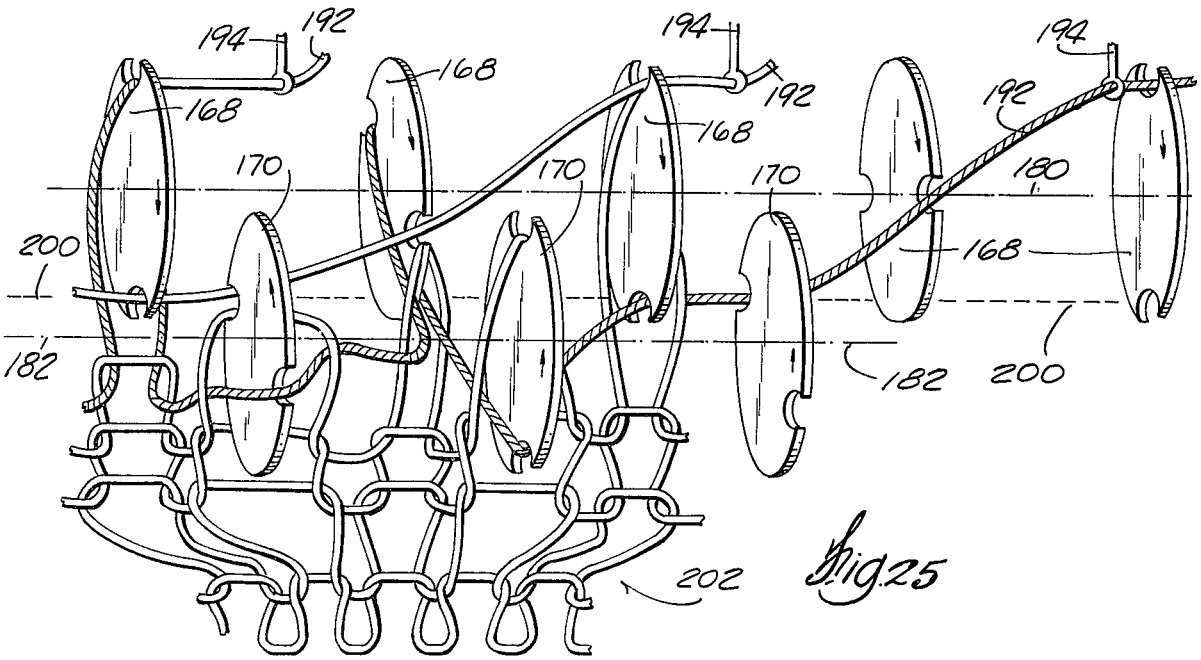
FIG. 25 is a perspective view of the rotary needles of the system shown in FIG. 23 illustrating the knitting of a ribbed knit fabric.

FIG. 25 illustrates the knitting action provided by the assembly shown in FIGS. 23 and 24 when rotary needles 168 are rotated clockwise and rotary needles 170 are rotated counterclockwise. Dotted line designated 200 indicates the point of coincidence between hook portions 184 of rotary needles 168 of rotary needles 170. As shown, a ribbed fabric 202 is produced.

A rotary needle arranged according to this invention can be conveniently used in conjunction with a reciprocating needle, such as a sewing machine needle, to provide bobbin-less chain stitching. Prior art machines including a rotary loop forming needle for this purpose typically employ a mechanism which drivingly engages the central portion of the needle. Consequently, some means must be provided to permit the thread to pass between the drive mechanism and the needle during loop formation. For example, Swedish patent 26,211 describes a device including a plurality of drive fingers which drivingly engage the side of the needle for rotating same and a cam arrangement for sequentially disengaging the drive fingers from the needle during rotation so as to allow the loop to pass between the drive fingers and the needle. Since the rotary needle assembly in accordance with this invention is driven by either a mechanical means which engages the needle periphery outside both the thread capturing area and the loop forming area or a magnetic coupling, the central loop forming area of the needle is completely unencumbered throughout a complete cycle without the necessity of providing additional means for periodically disengaging the needle drive mechanism.

Referring to FIGS. 14–18, reciprocating needle 98, carrying thread 100, moves up and down through adjacent layers 102 and 104 of a cloth material which are moved in the direction of arrow 106. Rotary needle 108, including hook sections 110 and 112, is located below the material at a position adjacent to reciprocating needle 98 when the latter is in the down position shown in FIG. 14. Rotary needle 108 is rotated clockwise as described above. The mechanism for rotating the rotary needle has been omitted to simplify illustrating the loop-in-loop formation.

Figure 14:
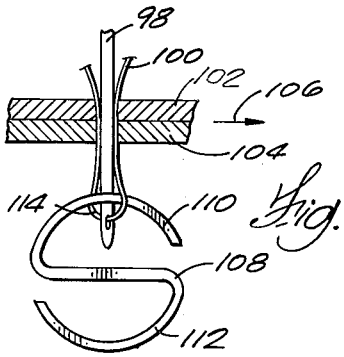
FIGS. 14–18 are side elevational views, partially sectioned and partially in diagrammatic form, illustrating the use of a rotary needle of this invention in conjunction with a reciprocating sewing needle to provide a bobbin-less chain stitch.
Figure 15:
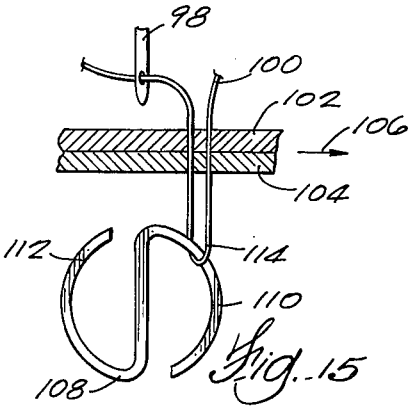
Figure 16:
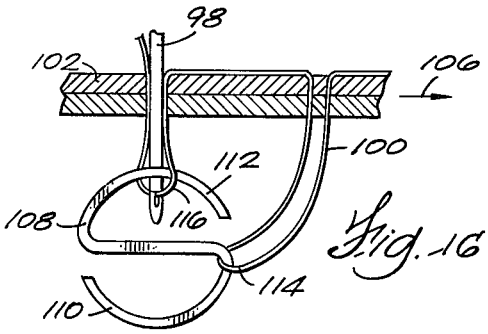
Figure 17:
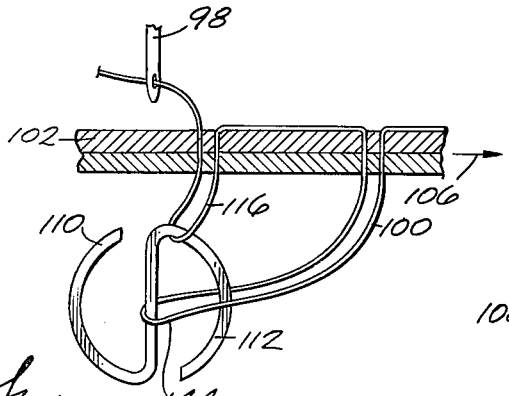
Figure 18:
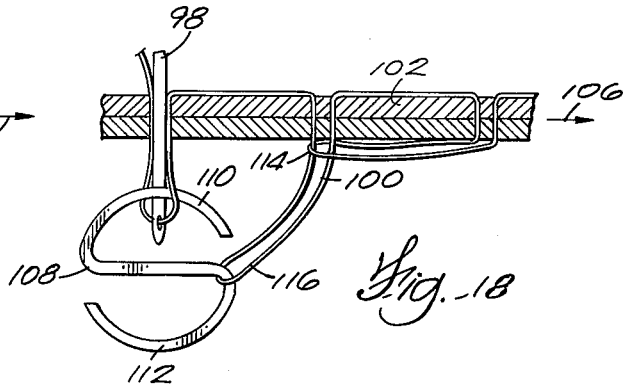

The rotation of rotary needle 108 is synchronized with the reciprocating movement of reciprocating needle 98 so that hook portion 110 captures a loop of thread 114 when the reciprocating needle is in the down position shown in FIG. 14. Thus, as shown in FIG. 15, loop 114 remains cpatured in hook portion 110 as reciprocating needle 98 moves up through the material and rotary needle 108 continues to rotate. After the material has advanced one stitch length to the right, reciprocating needle 98 moves downwardly through the material and another loop 116 of thread 100 is captured by hook portion 112 as shown in FIG. 116. As reciprocating needle 98 moves upwardly through the material and the material advances another stitch length to the right, hook portion 112 begins to pull loop 116 (FIG. 17). Upon further rotation of rotary needle 108, hook portion 112 pulls loop 116 through 114 and 114 is cast off. As shown in FIG. 18 loop 116 locks loop 114 into position as the cycle is repeated.

It can be appreciated that a rotary knitting needle assembly arranged in accordance with this invention can produce a wide variety of fabric arrangements by using the appropriate needle configuration and needle rotation. The needles are rotated, rather than being reciprocated such as by typical axial travel over rising and falling raceways in some conventional knitting machines, so they can be operated at higher speeds without inducing excessive vibrations. Since the knitting action provided thereby is not necessarily related to the relative axial motion of the needles, the yarn feeding system can be much more densely arranged, permitting strands of yarn to be fed into the needles more closely one after another. The rotational speed of individual needles can be varied which can be used advantageously to provide a wide variety of knitted fabric arrangements.

I claim:

1. A knitting device including at least one rotary needle including an outermost peripheral edge and at least two circumferentially spaced openings extending radially inwardly from said outermost peripheral edge, said openings defining loop forming means for releasably capturing and pulling a segment of filament into a loop as said rotary needle is rotated about an axis extending through its center of rotation;

drive means for rotating said needle about said axis, said drive means operatively engaging only said outermost peripheral edge throughout the entire rotational cycle of said needle such that the internal portion of said needle on which said loop is carried remains completely unemcumbered throughout the entire rotational cycle of said needle, said drive means supporting said needle so that said center of rotation is not at any time radially displaced from said axis during rotation of said needle; and means for feeding filament to the vicinity of said rotary needle so that, during a rotational cycle, one of said loop forming means sequentially captures a first segment of filament and pulls it into a first loop, the circumferentially adjacent loop forming means captures another segment of filament and pulls it into a second loop through the first loop, and the loops are released by their respective loop forming means after at least one loop of filament has been pulled therethrough.

2. The device according to claim 1 wherein said loop forming means comprises a hooked portion arranged to sequentially capture a segment of filament, pull the filament segment into a loop and allow the thus-formed loop to slip off said rotary needle as it is rotated in one direction.

3. The device according to claim 2 wherein said rotary needle is generally S-shaped.

4. The device according to claim 2 wherein said rotary needle is a disc with said hooked portions being cut outs on the periphery thereof.

5. The device according to claim 1 wherein said rotary needle is rotatably carried in a raceway including a slotted opening for receiving said filament from said filament feed means;

said rotary needle includes a permanent magnet; and said drive means for each of said rotary needles includes at least two center-tap wound electromagnets, the poles of which are arranged adjacent to the periphery of said rotary needle so that said rotary needle can act as a rotor of a multi-phase, 2-pole electric motor, and an electrical supply, and switching means electrically interconnected with said electromagnets and said electrical supply for selectively changing the polarity of poles of said electromagnets with respect to said permanent magnet to rotate said rotary needle.

6. The device according to claim 5 wherein said raceway carries a plurality of said rotary needles in axially spaced relationship for coaxial rotation about their central axis and has a generally circular cross section, a plurality of spaced guideways in each of which one of said rotary needles is rotatably disposed and an elongated slot generally parallel to the axis of rotation of said rotary needles and wherein said filament feed means is adapted to feed filament through said slot into said loop forming means of said needles.

7. The device according to claim 1 wherein said drive means comprises at least five drive rods drivingly engaging the outer periphery of said rotary needle, said drive rods being circumferentially spaced relative said rotary needle so that at least three of said drive rods are drivingly engaging said rotary needle outside said loop forming means; and means for rotating said drive rods.

8. The device according to claim 1 including a plurality of equally spaced gear teeth on the outer periphery of said rotary needle;

at least two hook portions on said rotary needles, each of said hook portions located between adjacent gear teeth;

a raceway carrying a plurality of said rotary needles in axially spaced relationship for coaxial rotation about their central axis, said raceway including a pair of diammetrically opposed sections which are spaced apart to provide elongated openings therebetween and are adapted to rotatably capture said rotary needles;

a drive member which is adapted for axial movement relative to said rotary needles within one of said openings and includes parallel, spaced ridges for slidably engaging the teeth of said rotary needles, said drive member ridges being angularly arranged with respect to the rotational axis of said rotary needles so that axial movement of said drive member causes rotation of said rotary teeth; and means for moving said drive member axially with respect to said rotary needles.

9. The device according to claim 8 wherein said raceway is arranged to carry first and second groups of said rotary needles for rotation about respective first and second parallel axes and includes three sections which are circumferentially spaced to provide elongated openings therebetween and are adapted to rotatably capture said first and second groups of rotary needles in interleaving, overlapping relationship so that the hook portions thereof can coincide at one point during their rotation cycles, separate of said drive members are provided for respectively driving said first and second groups of rotary needles; and means for moving each drive member axially with respect to its respective group of rotary needles.

10. The device according to claim 9 wherein said first and second groups of rotary needles are rotated in the same direction.

11. The device according to claim 10 wherein said first and second groups of rotary needles are rotated in opposite directions.

* * * * *